US010204602B2

(12) United States Patent
Quercetani

(10) Patent No.: US 10,204,602 B2
(45) Date of Patent: Feb. 12, 2019

(54) DISMOUNTABLE STRINGED MUSICAL INSTRUMENT WITH SPLITTED FINGERBOARD

(71) Applicant: Gionata Quercetani, Sant'llario d'Enza (IT)

(72) Inventor: Gionata Quercetani, Sant'llario d'Enza (IT)

(73) Assignee: Gionata Quercetani, Sant'llario d'Enza (IT)

( * ) Notice: Subject to any disclaimer, the term of this patent is extended or adjusted under 35 U.S.C. 154(b) by 0 days.

(21) Appl. No.: 15/698,196

(22) Filed: Sep. 7, 2017

(65) Prior Publication Data

US 2018/0158439 A1 Jun. 7, 2018

Related U.S. Application Data

(60) Provisional application No. 62/385,981, filed on Sep. 10, 2016.

(51) Int. Cl.

| | |
|---|---|
| ***G10D 1/02*** | (2006.01) |
| ***G10D 3/06*** | (2006.01) |
| ***G10D 3/00*** | (2006.01) |
| ***G10D 3/02*** | (2006.01) |

(52) U.S. Cl.
CPC ..... *G10D 1/02* (2013.01); *G10D 3/003* (2013.01); *G10D 3/02* (2013.01); *G10D 3/06* (2013.01)

(58) Field of Classification Search
CPC ..... G10D 1/02; G10D 3/06; G10D 3/003
USPC ..... 84/291
See application file for complete search history.

(56) References Cited

U.S. PATENT DOCUMENTS

| | | | | | |
|---|---|---|---|---|---|
| 3,657,462 | A * | 4/1972 | Robinson | G10D 1/08 | 84/267 |
| 3,910,151 | A * | 10/1975 | Copeland | G10D 1/08 | 84/267 |
| 4,073,211 | A * | 2/1978 | Jorgensen | G10D 1/08 | 84/267 |
| D249,387 | S * | 9/1978 | Hart | D17/17 | |
| 4,111,093 | A * | 9/1978 | Field | G10D 1/08 | 84/267 |
| 4,191,085 | A * | 3/1980 | Litwin | G10D 3/06 | 84/291 |
| 4,770,079 | A * | 9/1988 | Mastroianni | G10D 1/00 | 84/267 |
| 5,233,896 | A * | 8/1993 | Worthington | G10D 3/06 | 84/293 |

(Continued)

*Primary Examiner* — Elvin G Enad
*Assistant Examiner* — Christina Schreiber

(57) ABSTRACT

A dismountable stringed musical instrument with a splittable fingerboard and an acoustic sound is disclosed having a hollow body composed by two parts shaped as half empty shell that meets each other on their outer perimeter, defining a sound chamber. The fingerboard is splitted in two parts that can be re-assembled by a rigid inner core which works as a reinforcement and as a trail to allows the fingerboard cutted portions to slide on it meeting each other perfectly and by a latch toggle clamp which hold the two parts strictly merged together, taking back the fingerboard to its original playable smoothness. The neck can be dismounted to from the body and then re-assembled in the playing position also adjusting its inclination at will by movable elements placed on the neck extremity which faces the top portion of the body support area.

5 Claims, 7 Drawing Sheets

(56) References Cited

U.S. PATENT DOCUMENTS

| | | | | | |
|---|---|---|---|---|---|
| 5,353,672 | A * | 10/1994 | Stewart | G10D 3/06 | 84/267 |
| 5,994,633 | A * | 11/1999 | Norton | G10D 1/085 | 84/290 |
| 6,025,548 | A * | 2/2000 | Ehrlich | G10D 1/08 | 84/267 |
| 6,353,164 | B1 * | 3/2002 | Corsi | G10D 3/06 | 84/290 |
| 6,791,022 | B2 * | 9/2004 | Green | G10D 1/085 | 84/290 |
| 7,375,267 | B2 * | 5/2008 | Poschelk | G10D 1/08 | 84/291 |
| 8,273,974 | B1 * | 9/2012 | Gonzalez | G10D 1/085 | 84/267 |
| 9,454,947 | B1 * | 9/2016 | Hart | G10D 3/06 | |
| 9,514,719 | B1 * | 12/2016 | Ward | G10D 1/08 | |
| 9,697,808 | B1 * | 7/2017 | Sanzo | G10D 3/06 | |
| 2005/0098018 | A1 * | 5/2005 | Tamura | G10D 1/02 | 84/302 |
| 2007/0289427 | A1 * | 12/2007 | Liang | G10D 1/08 | 84/291 |
| 2008/0141488 | A1 * | 6/2008 | Leach | G10D 1/08 | 16/223 |
| 2009/0071318 | A1 * | 3/2009 | Miniaev | G10H 1/32 | 84/731 |
| 2009/0084243 | A1 * | 4/2009 | Pyper-Scott | G10D 1/08 | 84/293 |
| 2009/0100981 | A1 * | 4/2009 | Chadwick, V | G10D 1/08 | 84/293 |
| 2014/0116226 | A1 * | 5/2014 | Saito | G10D 1/085 | 84/291 |
| 2018/0053491 | A1 * | 2/2018 | Spangler | G10D 1/08 | |
| 2018/0158439 | A1 * | 6/2018 | Quercetani | G10D 3/02 | |

* cited by examiner

DISMOUNTABLE STRINGED MUSICAL INSTRUMENT WITH SPLITTED FINGERBOARD

CROSS REFERENCES TO RELATED APPLICATIONS

Claims benefits of a provisional application No. 62/385,981, filed on Sep. 10, 2017 entitled "Dismountable stringed musical instrument" which is hereby incorporated by reference.

BACKGROUND OF THE INVENTION

The present invention relates generally to improvements of stringed musical instruments and, more particularly, to an easily transportable electric double bass while keeping the same sound quality and playing feel of a traditional acoustic double bass. The invention can be applied to various bowed stringed instruments belonging to the violin family such as cellos, violones, and other like stringed instruments. However, the invention is particularly advantageous when applied to an instrument such as a double bass. This specification is written to be understandable by any person who, at least, have already seen a bowed stringed instruments and who basically knows how it works to emit sounds following the musician action on the instrument itself. So, the most common parts of this type of instruments, and concepts like sound chamber or intonation, are taken for granted and assumed as a necessary basic knowledge to completely understand the description of the invention.

Transporting stringed musical instruments is an endeavor with many perils. This is especially true for stringed musical instruments like the double bass due to its size and fragility. The top, back, and sides are typically constructed of spruce and maple, usually not more than ⅜" thick; the standard dimensions of a ¾ acoustic double bass (not the biggest size for this kind of instrument but still the most common) are approximately 74" height×27" width×25" depth. Furthermore, the double bass is usually more expensive and, due to its fragility, a slight bump in the wrong place can cause the neck to snap completely off or to crack in some parts of the body (to take some quick examples), compromising the instrument's functionality and usability, requiring difficult, precise, specialized, and expensive repairs.

The first solution to the difficult transportation and safekeeping of the double bass is to carry it in a hard shell case. Unfortunately, hard cases are very expensive and at the same time very bulky. They are too bulky to fit comfortably in cars and, moreover, are typically larger than the limitations imposed by air lines concerning carry-on baggage. However, even if the instrument is allowed on the airplane, either as carry-on baggage or checked baggage (upon payment of expensive fees), damage to the instrument being transported in a hard shell case is rather common. Obviously, the problem cannot be solved using a soft bodied case: even though it can be less bulky, it cannot surely reduce the bulkiness of the double bass itself offering, regardless, inadequate protection for the instrument during travel, always at risk to be subjected to bumps. Furthermore, with heightened security measures at airports presently in effect, many airlines refuse to transport double basses at all.

A second solution is to rent an instrument at your destination. In addition to the expense of renting an instrument (usually not refunded to the musician), rental instruments are often of inferior quality, dissimilarly configured, and of unfamiliar setup or "feel". Consider for example an international musician that, during an international tour of several dates, needs to rent a double bass at each location he plays: it becomes a big waste of time planning how and where to rent, ending up using a different instrument at each gig, all the while having to take on all rental costs and, obviously, having a bad effect on musician's performance.

Consequently, due the obvious impossibility of easy, quick, and economical transport of an acoustic double bass, the solution was to create an electric double bass, also named electric upright bass (EUB). In these instruments, the sounding body is replaced by a much smaller and less bulky solid body (or, sometimes, a "skeleton" body, made up only by the frame of the body) minimizing the elements necessary for a double bass that could be played by musicians trained on traditional double basses. The sound amplification functions are entrusted to electronic devices such as microphones or piezoelectric pickups positioned on or near the bridge. With this smaller and thinner body the instrument is surely less bulky laterally and much less heavy, but its height remains very hard to handle, so some prior art electric upright basses can be disassembled by breaking down the neck from the body, disassembling other elements like the tailpiece, or equipping the instrument with a telescopic endpin, to ease transportation. But all of these prior disassembling methods are stopped by the obstacle of the neck and fingerboard integrity: the fingerboard must be solidly attached to the neck, and the fingerboard is longer than the neck itself, so the fingerboard is the longest part of the instrument that can't be splitted or disassembled because the main and essential purpose of the fingerboard is to be perfectly smooth and without any junction points or gaps, to allows the musicians to play with the perfect and right intonation that they are able to do.

All these improvements allow the electric upright bass to fit in a smaller hard case, able to fit in turn into a car, for example.

Electric upright basses appear to be the final solution for double bassist allowing them to have instruments that could always be carried easily everywhere, but this solution makes the sound of the instrument poorer in tone and quality, less brilliant, warm, and "acoustic", resulting in a sound that is very different from that of a real acoustic double bass. The sound is so different, that the electric upright bass became essentially a separate category of instruments, due its unique sound completely different from that of a real double bass in terms of feedback, brilliance, groove, sustain, tone and presence. Some electric upright basses have a small, hollow resonant chamber, but it isn't enough to fill the gap of sound quality compared to acoustic double basses.

Thus, what is needed is a stringed acoustical instrument that can be disassembled in an easy and fast way to become as small and as light as possible and that can be easily transportable by car, plane, and all other modes of transportation. All of these features are necessary without sacrificing sound quality, the playability, the musician's feel, and the authenticity of the sound.

However, no previous attempts completely solved the problem described above as well as the present invention.

BRIEF SUMMARY OF THE INVENTION

This invention is directed at stringed musical instruments such as the double bass, cello, or similar stringed instrument to ensure easy transportability without losing sound quality, while still being able of being disassembled.

The instrument is able of being disassembled in four main parts: the fingerboard, the neck, the body and the shoulders.

The upper end of the body presents a housing where the end part of the neck can be precisely accommodated and mounted in the playing position.

A pin through slotted hole joint system holds the neck in a way that will be firmly joined once the strings are mounted thanks to string tension pulling in the opposite direction of the junction fulcrum.

The neck presents a T hammer bolt which come off its back and that slides into a slotted hole on a rigid plate positioned on the back of the body.

This junction pulls the neck in the opposite direction from the string tension, so that, when the strings will be mounted, the neck will be firmly joined to the body in its defined playing position.

In addition to this, the fingerboard can be unmounted in two parts: the junction point coincides near the end of the neck. This is a significant difference from other prior art instruments, because the fingerboard is one of the longest parts of the instrument making it impossible to split due to its necessity of being smooth and without any junction points. In the present invention, this is possible thanks to a rigid core in the neck, made up of a T bar specifically designed and shaped that slides into a dovetail slot on the final part of the fingerboard. These two parts are joined perfectly and tightly, and form a single unique piece, by a latch toggle clamp, positioned on the back face of the fingerboard.

Thus, this allows the instrument to be further disassembled, and occupy less space during transportation than any prior art instrument.

In preferred embodiment, the body is a wooden hollow acoustic chamber with a specifically designed shape made by two empty shells which meets each other on the outer outline edges, creating an enclosed resonating hollow space between them. Acoustic chamber can be obtained also joining together more than two elements, enclosing a hollow space into them, as is typically seen in most acoustic stringed musical instrument which use periphery element that extend between the first outer perimeter of the front face of the body (called soundboard) and the second outer perimeter of the back face of the body.

Its shape and its differently rounded faces give the instrument a strong, brilliant, rich, sustained, authentic acoustic sound, thanks also to the wood processing technique and geometrically perfected body wall thickness that make the entire instrument free to vibrate and to projecting the resonances of the soundboard.

The front face of the body (soundboard) presents six sound holes; additionally, there are two recessed slots, to house the bridge feet. These slots allow the musician to set the bridge in the same correct position every time, speeding and simplifying the mounting process.

The present invention incorporates an innovative and unique tool to further facilitate the bridge mounting and positioning. It is a shaped thin metal bar that works like a lever with a fulcrum at the tailpiece base where it needs to be pushed to be inserted. At the other extremity of the tool, the bridge is held flush to the soundboard, fastening the bridge during strings mounting and tuning. This is an additional positive innovation that contributes to make easier and faster the mounting and unmounting procedure of the instrument.

The familiar tailpiece is eliminated in the present invention: instead of anchoring the strings to the tailpiece, the strings are anchored to the body itself. At the bottom of the body, at its extremity, a wooden telescoping endpin is completely contained into instrument body.

The present invention is designed to provide the exact tactile and visual reference a trained double bassist requires for ease of performance: the invention is immediately playable and comfortable to anyone familiar with the traditional acoustic double bass. Thus, the invention is fitted with two collapsible shoulders that replicate the exact shape and outline of an acoustic double bass upper part. The musician can lean on them exactly like a classic double bass, maintaining the same tactile feeling. Like all the other parts of the invention, the two shoulders are designed to take up as little space as possible, and can be folded and placed easily in the specifically designed case, with all the other parts. The junction point with the body is in the same place of the neck and body junction, so that all the junctions on the body to other parts are hidden under a cap shaped in compliance with the body shape. The two shoulders have, at the extremity oriented to the body top, an L rigid plate with a keyhole slot by which the shoulders can be attached to the body on the suitable nailed head pins.

BRIEF DESCRIPTION OF THE SEVERAL VIEWS OF DRAWINGS

DESCRIPTION OF THE PREFERRED EMBODIMENT

Referring now to the figures in greater detail, where like reference numbers denote like parts in the various figures: the present invention will be described by way of an illustrative example (using a double bass).

Figure 3:
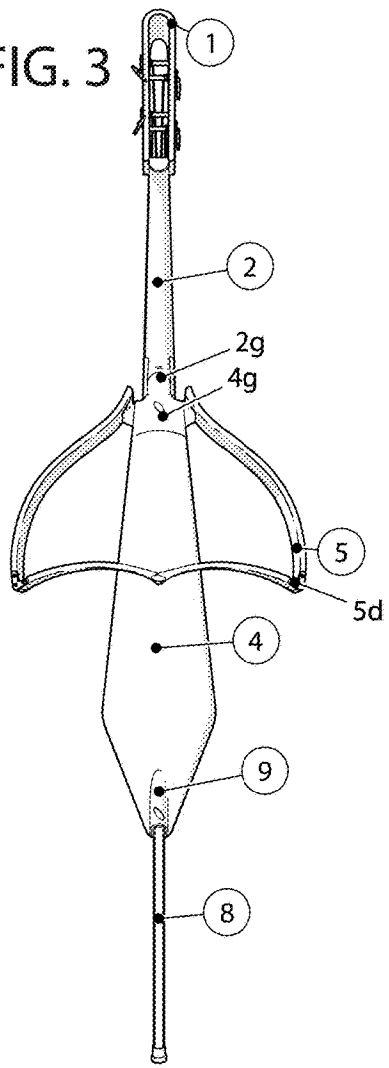
FIGS. 1, 2, 3 are, respectively, the front, side and back view of the instrument mounted in its entirety.
Figure 2:
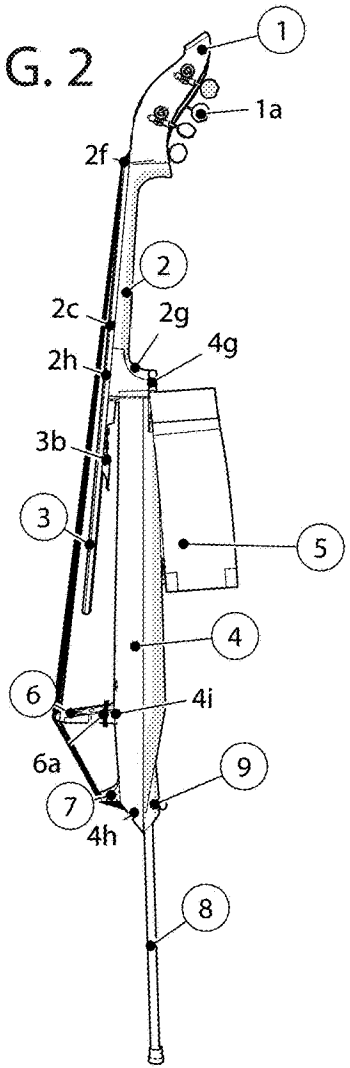
Figure 1:
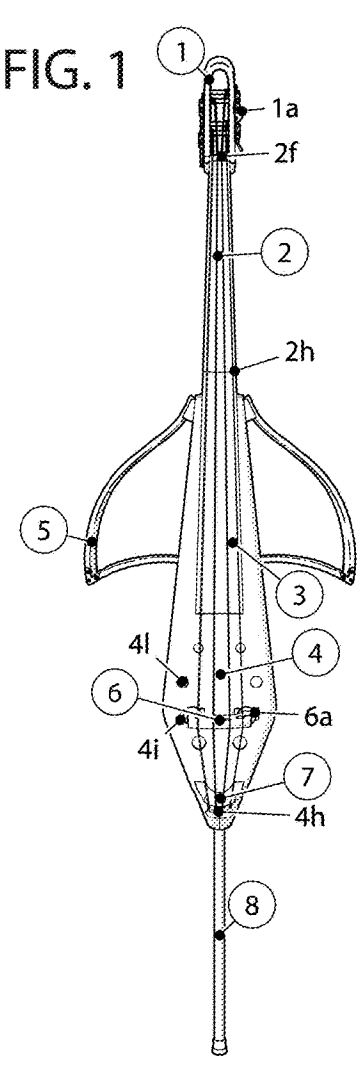

In FIGS. 1, 2 and 3 there is shown an electric upright double bass constructed in accordance with the present invention where you can see the main parts of the instrument, that will be described specifically at a later point, defined by circled callouts from 1 to 11.

Conventional tuning gears 1*a* are mounted on the head 1 of the instrument on the top of the neck 2 that run out on the body 4. The neck and the body can be easily disassembled, consistently with the intention of the present invention. The neck 2 is equipped with a fingerboard 3 that looks in shape and usability like a conventional ebony double bass fingerboard, except for the transverse cut that divides it in two parts, easily conjoining it without any junction point or step perceptible by touch. In this graphic presentation, for clarity, it is called fingerboard 3 only the part that can be dismantled from the entire fingerboard, considering the part in-built with the neck 2 as part of the neck itself.

A plurality of playing strings are stretched out from the string rent 4*h* on the lowest part of the body 4 passing over the tailpiece 7 and the bridge 6, up to the nut 2*f* ending on the tuning gears 1*a* hub. It will be clearly understood that the number of strings arranged along the neck and the body portions depends on whether four, five or other type string arrangement is desired.

The present string musical instrument further includes a piezoelectric bridge 6 pickup with adjustment wheels 6*a*, that allow adjustment of the bridge 6 height by turning them. The bridge is held against the body 4 by the tension of the strings in a direction transversal to the longitudinal axis of the neck 2 and roughly equidistant from the end of the fingerboard 3 and string tailpiece, precisely in two slots 4*i* on the body that house perfectly the bridge feet, to ensure the ideal positioning whenever it is placed for strings mounting.

The preferred embodiment according to the present invention shows the body 4 as a wooden hollow acoustic chamber with a specifically designed shape. In the present invention, the hollow body 4 is made by two parts, the front face (called soundboard) and the back face, attached together and shaped as empty shells which meet each others on their respective perimeter, or border. The spatial arrangement between the soundboard and the back face define the acoustic chamber 4 which has a substantial impact on the characteristics of the sound produced by the stringed instrument.

Acoustic chamber can be obtained also combining together more than two elements, enclosing a hollow space into them, as is typically seen in most acoustic stringed musical instrument which use periphery element that extend between the first outer perimeter of the soundboard and the second outer perimeter of the back face of the body.

As such, deformations or imperfections in the acoustic chamber 4 can have a negative impact on the sound produced by the musical instrument, and, as well, a unadulterated acoustic chamber, with a specific inner thickness and a geometrically perfect surfaces can improve the sound quality of the instrument itself.

In the present invention, the body 4 shape and its differently rounded faces give the instrument a strong, brilliant, rich, sustained, authentic acoustic sound, also thanks to wooden processing technique and geometrically perfect body wall thickness that make the entire instrument free to vibrate.

The front face of the body (soundboard) presents six sound holes 4*l*. The hollow body also permits the entire containment of the endpin 8 when the instrument is dismounted for transportation. The endpin 8 slides in and out of the body 4 through a specific hole 9 on the bottom of the back side of the body 4. The endpin housing 9 is equipped with a mechanical locking system that permits the user to set the preferred length of the endpin 8 extends out of the body 4.

An important feature of the present invention is the two foldable shoulders 5 attached to the upper back part of the body 4, providing the correct overall balance and the proper player-to-instrument contact. As shown in FIGS. 1 and 3, the shoulders 5 substantially replicate the shape and the outline of the top portion of the traditional acoustic double bass body extending out from the body 4 laterally and backward. They make contact with the player body in the proper playing position, giving him the same feeling on the instrument as on a traditional double bass, replicating the exact tactile and visual references a trained double bassist requires for ease of performance: the invention is immediately playable and comfortable to anyone familiar with the traditional acoustic double bass.

The shoulders 5 are removable and mounted on the back of the body 4, near the neck-body junction, exactly in the portion defined in FIG. 3 by the junction cover 4*g*, that covers the junction and holds static all the joint parts involved, without play and vibrations.

Referring now to the FIGS. 4, 5, 6, 7, 8 and 9 the present invention will be described more specifically in every constructive detail following the assembly steps needed to bring the invention to its playable position, consistently with one of its main feature: the disassembly system that allows it to occupy the smallest space possible.

Figure 4:
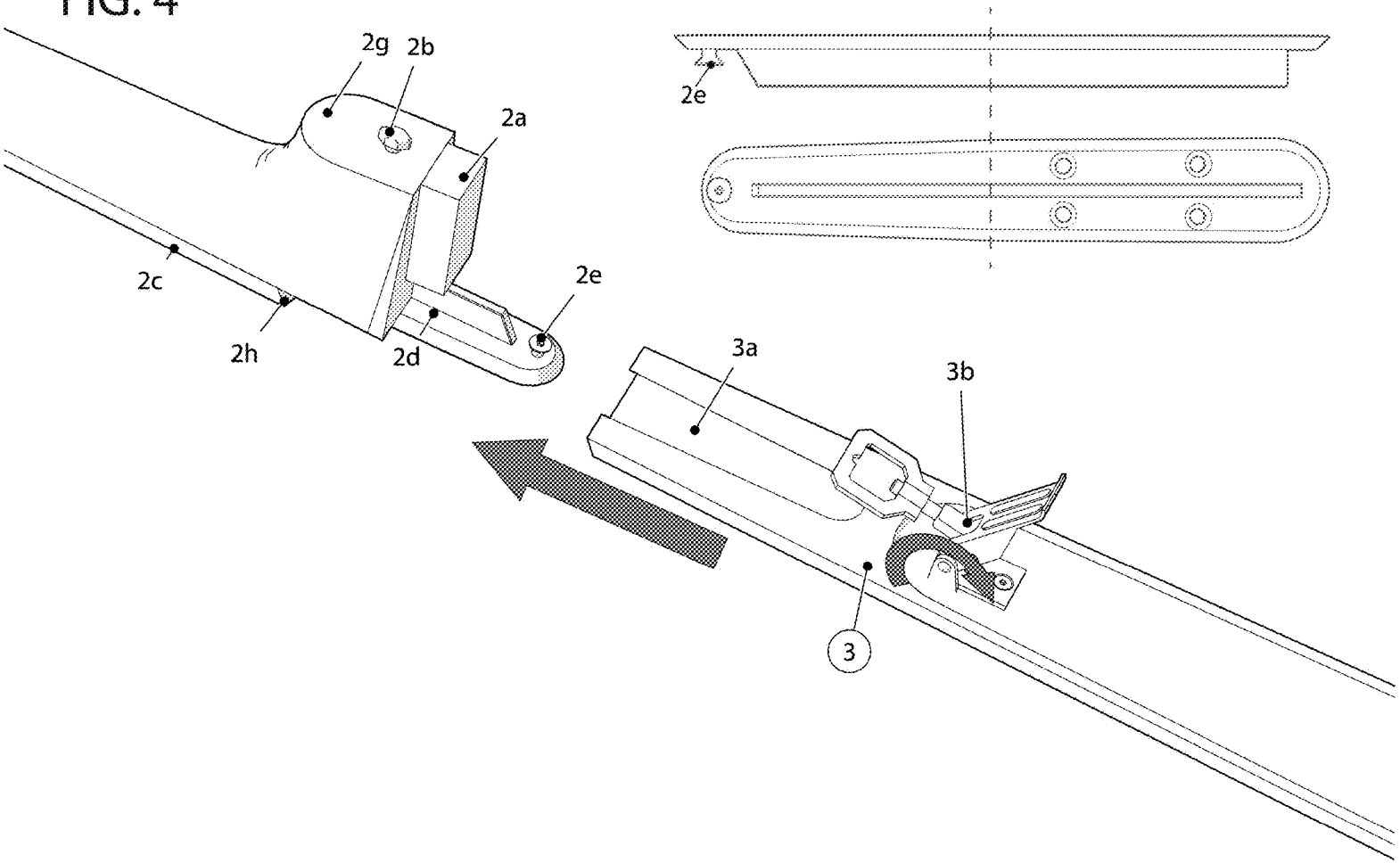
FIG. 4 is a perspective view of the fingerboard mounting system which shows all the elements involved in the mounting system itself, while also shows a top and side view of the main element 2*d*.

As shown in FIG. 4 the fingerboard 3 can be unmounted from the neck 2, separating it from the neck fingerboard portion 2*c*. The neck 2 is equipped with a rigid core fixed to the fingerboard portion 2*c* and it works as a support for the two divided parts of the original fingerboard. In the preferred embodiment of the present invention, this rigid core support is made up of a t bar 2*d* with a specifically designed shape. In the present invention the t bar 2*d* is made of aluminum or like material that satisfies the needed resistance needed to support the fingerboard 3 junction. The t bar 2*d* is a rigid plate of thickness less than the fingerboard 3 thickness, it is presented as a rounded rectangle with a tapered bottom half from the middle to the end, it's oriented lengthwise to the neck 2 with the smallest radius extremity pointed towards the end part of the neck 2. Tapered bottom has circa 1.4 degree taper angle, which is the perfect declivity to allow the rigid bar 2*d* to slide in and out from the same shaped recess 3*a* on the fingerboard 3 easily and effortless, but also different taper angle may works as well.

The height of the reinforcement ribbing is completely inserted in the neck 2, while the plate is covered by the neck fingerboard portion 2*c* from the extremity with the biggest radius to the beginning of the tapered portion that protrudes out of the end of the neck 2*a*. The edge of the plate 2*d* is entirely chamfered at 45°, to be perfectly fitted into the dovetail slot 3*a* in a univocal orientation without play and imprecisions. To assemble the fingerboard 3 with the neck fingerboard portion 2*c* it is necessary to slide the shaped t bar 2*d* inside the fingerboard 3 along the dovetail slot 3*a* as deep as possible by hand, or until the hook of the latch toggle clamp 3*b*, fixed to the back side of fingerboard 3, can reach the pin 2*e* positioned on the plate 2*d* in proximity to the smallest radius extremity. Clasped the pin, it is sufficient to push down the latch toggle clamp 3*b* lever, which consequently pull the hook backward to the fingerboard 3 end extremity, but, being the hook blocked by the pin 2*e*, the result is that the fingerboard 3 is dragged toward the neck fingerboard portion 2*c* following the path defined by the dovetail slot 3*a* until the two fingerboard parts 3 and 2*c* meet each other joining perfectly and tightly at the transverse cut 2*h* in a single whole piece, as the standard stringed instrument fingerboard which it was before the cut.

This junction is extremely stable and strong so that, together with the specifically designed transverse cut 2*h*, which split the original standard fingerboard perpendicularly to its length, doesn't show any kind of step or junction point perceptible by touch. This important feature allows the musicians to disassemble the fingerboard in two parts for easy transportation, without any negative tactile feedback on the fingerboard when it is be re-assembled for play.

Figure 5:
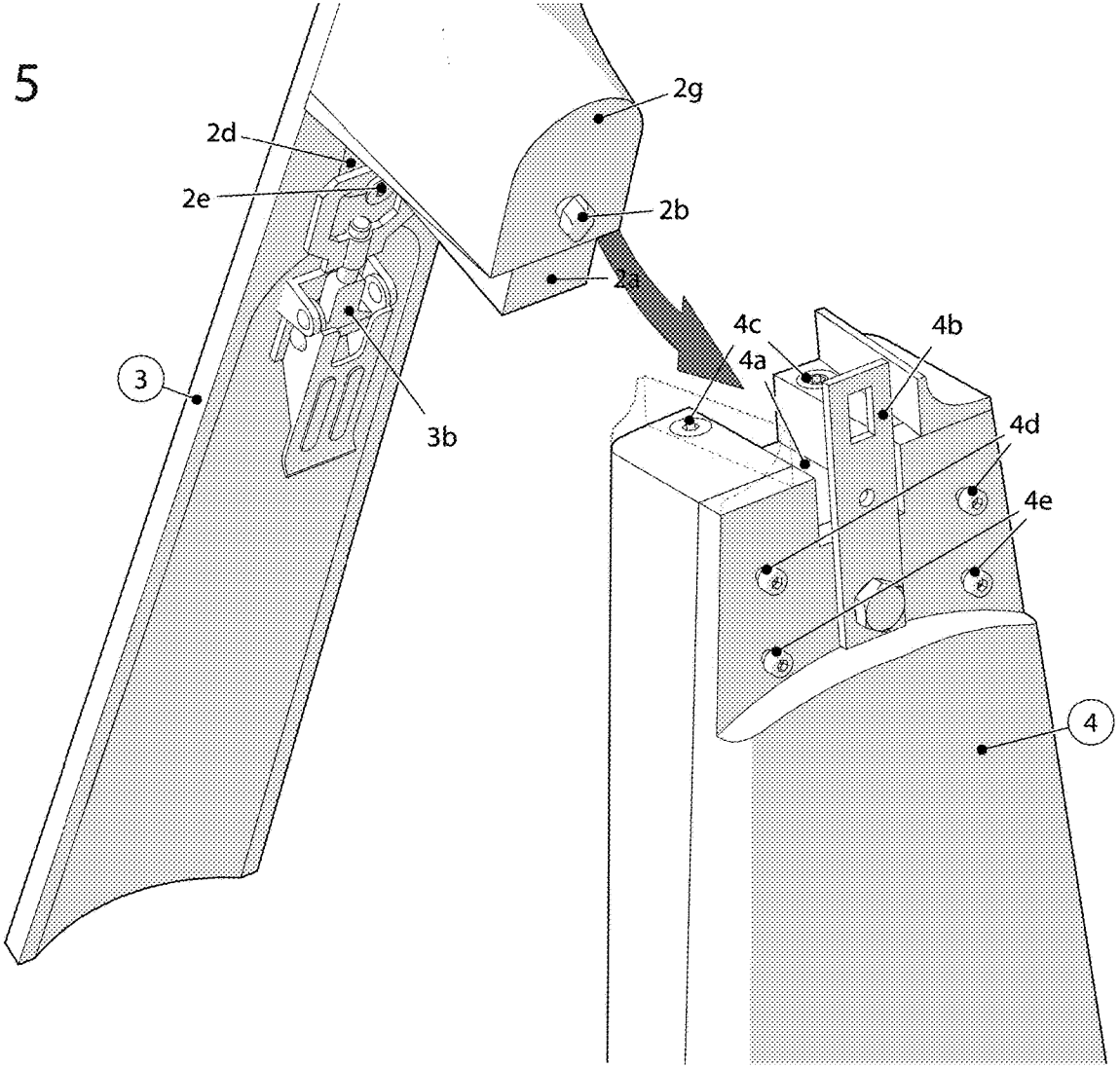
FIG. 5 is a perspective view of the neck to body mounting system which shows all the elements involved in the system itself together with the elements involved in the neck inclination adjusting system.

After having carefully described the fingerboard juncture, FIG. 5 shows the way to assemble the whole neck 2 (including the fingerboard 3) with the body 4 and all the correlated features.

The upper end of the body presents a housing 4*a* that works as a lane, through the front and the back face of the body, where the end part of the neck 2*a* can be precisely accommodated and the neck 2 mounted in the playing position.

The joint is essentially composed by a male part 2*a*, positioned under the back button 2*g* of the neck, precisely shaped to be housed into the slot 4*a* on the body 4.

The neck presents a T hammer bolt 2*b* which come off its back 2*g* and that slides into a slotted hole 4*f* on a rigid plate 4*b* positioned on the back of the body. Tilting slightly backward the neck 2, the t hammer bolt 2*b* head can pass through the slotted hole 4*f* and then it clasp the neck 2 to the plate 4*b* once the neck 2 is tilted back to the front, in playing position. At this point, the neck 2 is limited from tilt towards the front beyond the defined played position by the resistance of the t hammer bolt 2*b* against the rigid plate 4*b*. In addition to this, the strings tension pulls the neck 2 towards the front, limiting the neck 2 from tilt backward, so that, when the strings are mounted, the neck 2 is firmly joined to the body 4 because is limited to tilt towards the front by the rigid plate 4*b* and, at the same time, limited by the strings tension to tilt backward.

Back button 2*g* underside faces lean against the top horizontal face of the body, where there are two little neck grade adjustment screws 4*c* that can be screwed in or out equally to adjust the grade of the neck 2 forward and backward respect of the headstock orthogonal projection, or, unequally to also adjust the grade of the neck either towards the left or the right with respect to lengthwise centerline of the instrument, by changing the support points of the back bottom 2*g*. These adjustment of the grade of neck 2 have an impact on the distance of the strings from the fingerboard 3 which, thanks to this adjustment system, the user is able to adjust at his own preference before mounting the instrument and that will be stable along every assembly.

This locking system allows the user an easy and quick neck assembly on the body with an accurate grade adjustment and a robust fastening.

Figure 6:
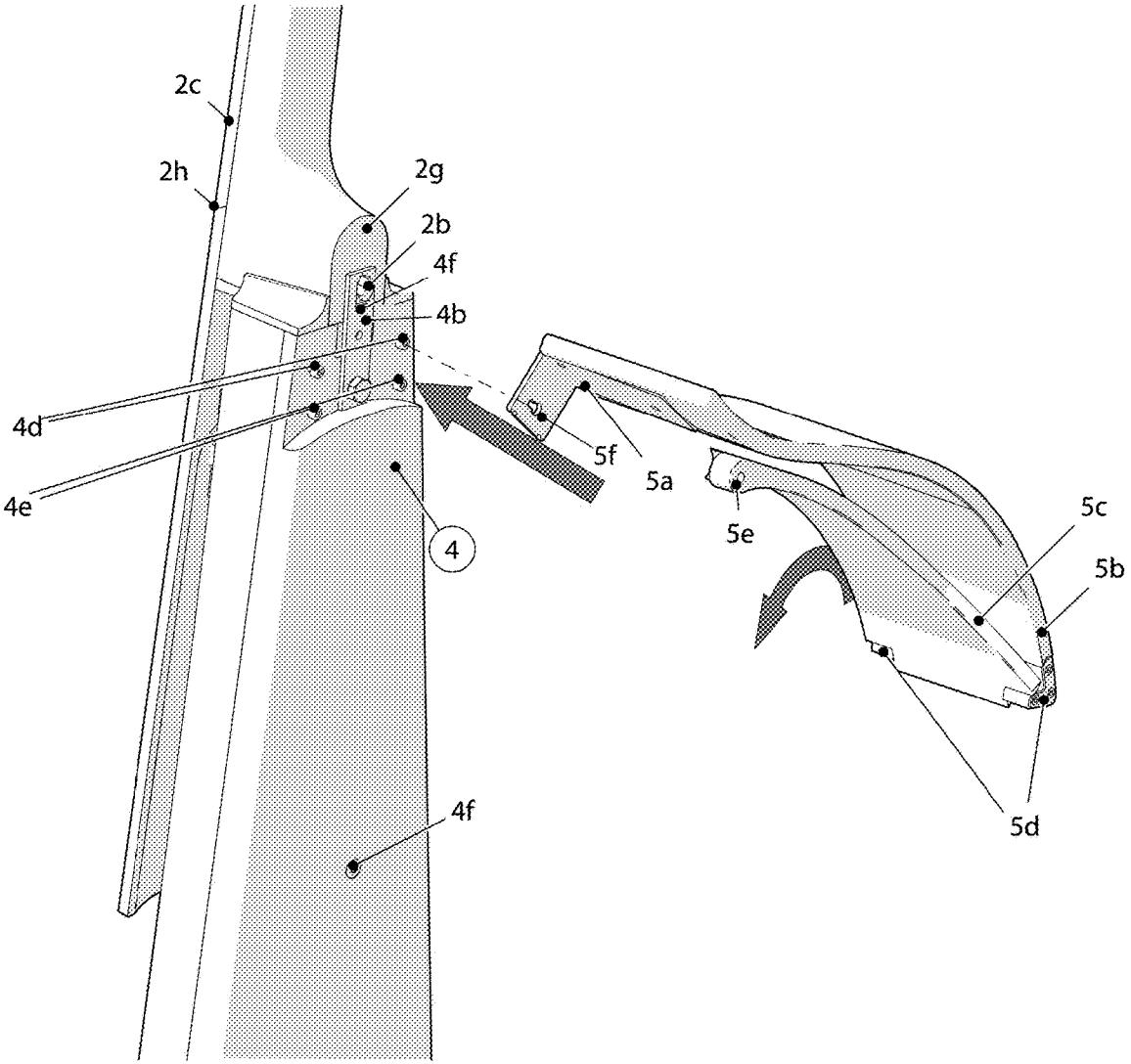
FIGS. 6 and 7 are perspective view of the shoulder mounting system and features, respectively, while being mounted and when mounted.
Figure 7:
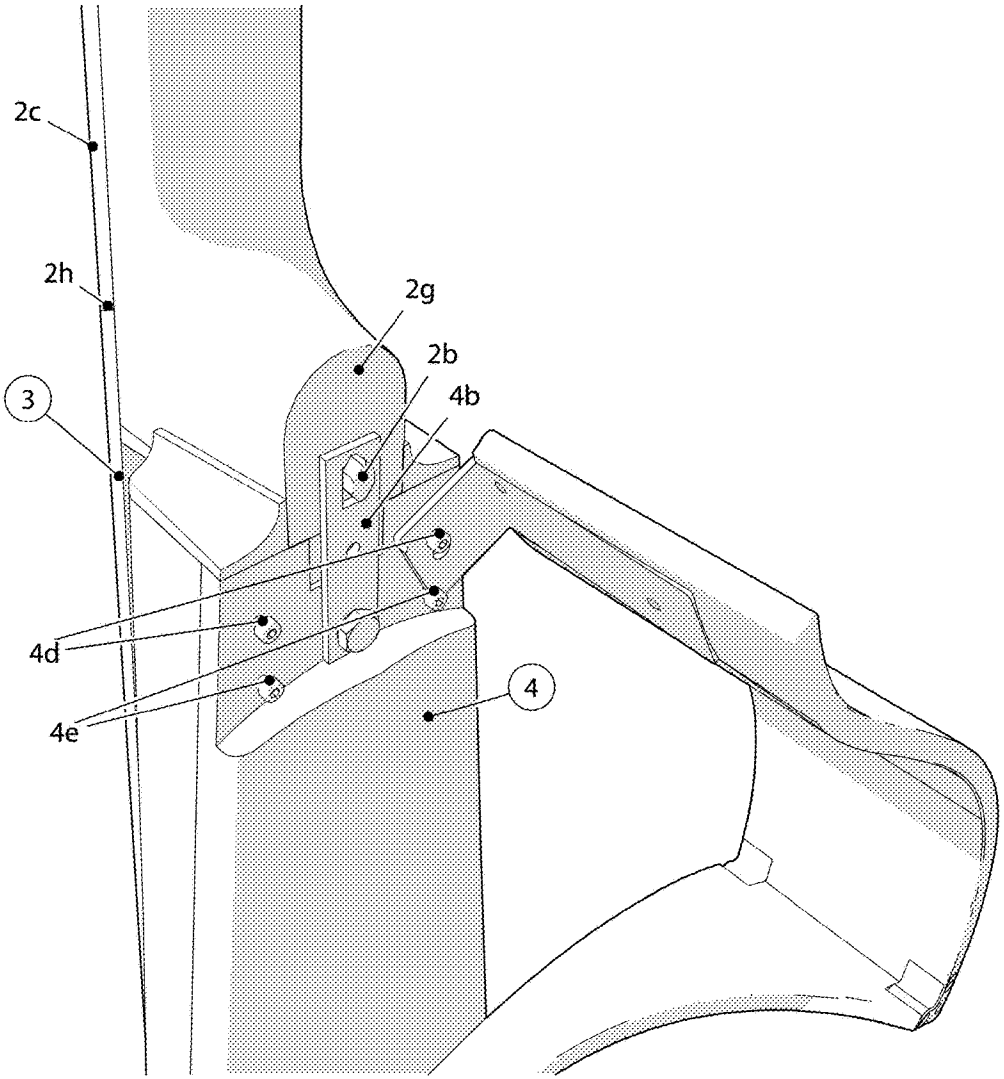

As described before, the present invention is fitted with two collapsible shoulders 5 that replicate the exact shape and outline of an acoustic double bass top portion of the body, as you can see in FIGS. 6 and 7. The shoulders are composed by an upper part 5*b*, that replicate the outline of an acoustic double bass body, and a lower part 5*c* that connects both the shoulders 5 to each other and to the body 4 with a thread sleeve 4*f* on the body back side by a threaded knob. The upper 5*b* and lower shoulder parts 5*c* are joined with two hinges 5*d* specifically designed and shaped to outline the shoulders 5 edges. In spite of their function being for support only, the shoulders lower part 5*c* matches the curvature of the upper part 5*b* of the same shoulder, to allow them to be folded over themselves through hinges 5*d* occupying the smallest space possible when in transportation arrangement.

To join the shoulders 5 to the body 4, the upper part of the shoulders 5*b* is equipped with an L plate 5*a* positioned with the longest face on the upper extremity of the upper part of the shoulder 5*b* parallel to the width of the shoulder itself. The smallest face of the L plate 5*a* presents a keyhole slot 5*f* profiled to let upper juncture pin 4*d* pass through it and clasp the shoulders 5 to the body. Inside the neck/body/shoulders join area, that is defined by the area that can be covered by the cover 4*g*, there are also two further juncture pins 4*e*, below the upper ones, that have the function of blocking the rotation of the shoulders inwards, that rotate around the upper juncture pins 4*d* towards the center of the body. These lower juncture pins 4*e* are housed into a small semi-circular hole on the edge of the L plate 5*a*, limiting its rotation.

Figure 8:
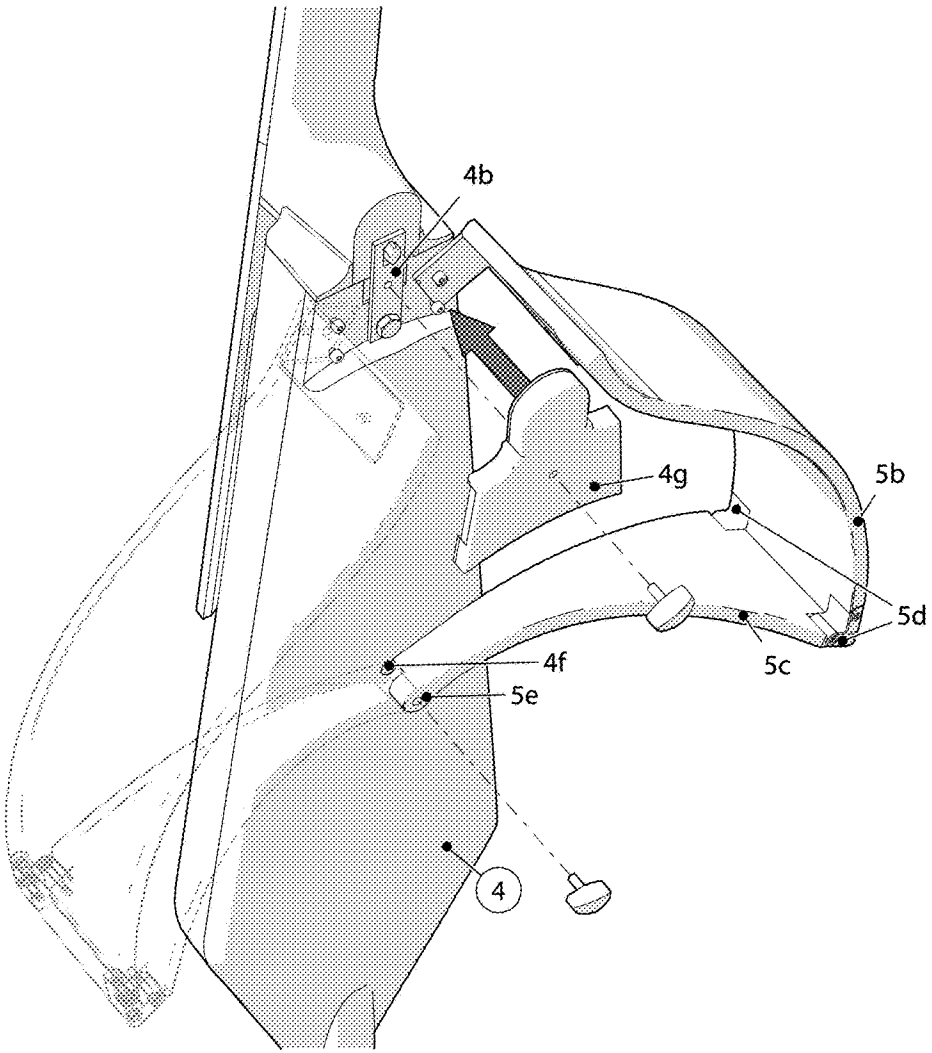
FIG. 8 is a perspective exploded view of the screws and the elements which are needed to complete the assembly of all the parts connected with the body which are shoulders and neck.

As showed in FIG. 8, when the shoulders 5 are correctly assembled on the body 4, as described above, the shoulders lower parts 5*c* can be unfolded to the limit imposed by the mechanical stop of the hinges 5*d* and the junction holes 5*e*, positioned on the extremity of the shoulder lower parts 5*c*, which are centered on each other with the thread sleeve 4*f* and fixed to the body 4 with the threaded knob.

Now the neck/body/shoulders join area can be covered by the cover 4*g* specifically shaped to outline the area, and fit with a soft vibration absorbing surface in the inner face to block all the juncture parts and to eliminate every possible vibration in that area, by squeezing against the area and by locking the cover with a threaded knob screwed in the threaded specific hole located in the middle of the plate 4*b*.

Figure 9:
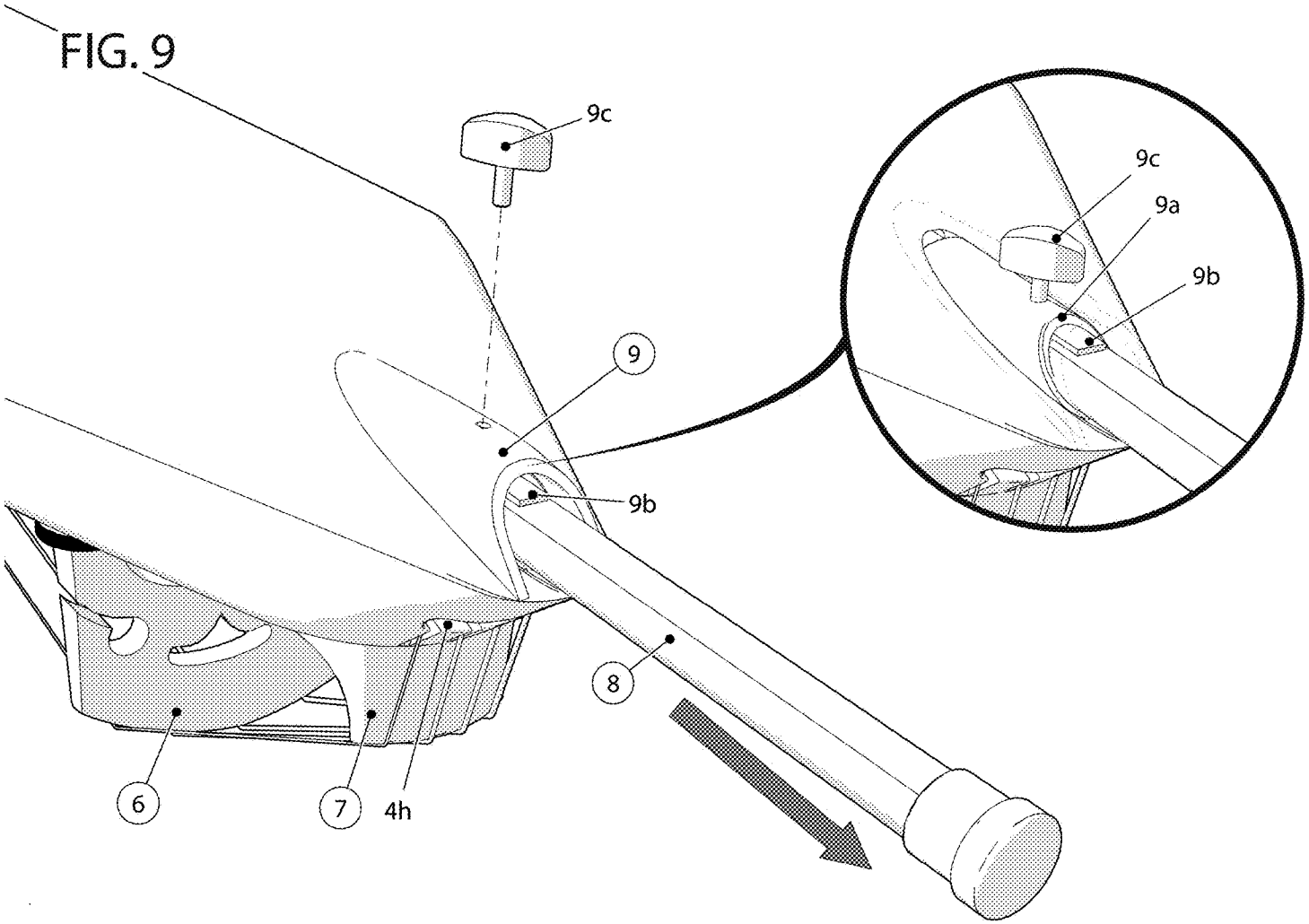
FIG. 9 is a perspective view of how the endpin length adjustment works, with a balloon showing more in detail the hide mechanism which lock the endpin at the desired length.

In FIG. 9 is showed the locking system to lock the endpin 8 in the preferred length out of the body 4. In the present invention, the endpin 8 is not a stringed musical instrument standard endpin. It is specifically designed with a material which is allowed to be board on plane (unlike the standard metal endpin), and also, it is not perfectly cylindrical: it has a flat surface narrower than the endpin 8 diameter itself.

On the back side of the body, on its bottom extremity there is positioned the endpin housing 9 that covers the inner housing pipe 9*a* that has the function of housing the endpin 8 in the correct angle and direction to let it be retracted properly inside the body 4 and drawn out in the correct position to ensure necessary instrument balance while playing. The pipe 9*a* presents a threaded hole perpendicular to its length that correspond to the hole on the endpin housing 9. Screwing in the endpin clamping knob 9*c* through the threaded hole on the inner pipe 9*a*, the threaded bar of the knob 9*c* pushes against the clamping bar 9*b*, contained inside the inner pipe 9*a*, consequently pushing against the flat face of the endpin 8, locking it in the preferred position, to avoid any possible sliding of the endpin 8 inside the body 4 under the weight of the instrument and the load of the musician in the playing position. The endpin 8 is fit with a non-slip tip 8*a* at its extremity that avoids the sliding of the instrument on the floor during the musician's performance.

I claim:

1. A foldable stringed musical instrument having a body with a lower end portion and an upper end portion, a neck having a lower end portion and an upper end portion and a plurality of strings running from the body to the upper end portion of the neck, wherein the instrument further comprises a) a playable fingerboard cut crosswise in at least two parts connected to each other on the cut's cross section wherein said playable fingerboard still keeps its characteristics of playability and said playable fingerboard is connected to said neck longitudinally; and b) a mounting apparatus configured to join said playable fingerboard parts together comprising:

i) an elongated rigid element connected to one of said playable fingerboard cut parts and said elongated rigid element having a portion protruding off from said cross section of said playable fingerboard cut part;

ii) a locking device connected to another one of said playable fingerboard cut parts;

wherein at least one part of said playable fingerboard cut parts, different from the said part which is connected to said elongated rigid element, presents a recess slot having the same shape and outline of the said protruding portion of the said elongated rigid element so that said protruding portion is housed into said recess slot.

2. The foldable musical instrument according to claim 1, in which said elongated rigid element has an engage element on its said protruded portion, and said locking device is clasped to said engage element.

3. The foldable musical instrument according to claim 2, in which said engage element is a pin.

4. The foldable musical instrument according to claim 1, in which said elongated rigid element is a T bar rigid plate.

5. The foldable musical instrument according to claim 1, in which said locking device is a latch hook clamp.

* * * * *